US007561840B2

(12) United States Patent
Morimoto et al.

(10) Patent No.: US 7,561,840 B2
(45) Date of Patent: Jul. 14, 2009

(54) TRANSFER ENDLESS BELT DEVICE APPLIED TO IMAGE FORMING APPARATUS

(75) Inventors: Shigenori Morimoto, Kashihara (JP); Masanori Yamada, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 489 days.

(21) Appl. No.: 10/595,285

(22) PCT Filed: Oct. 1, 2004

(86) PCT No.: PCT/JP2004/014510

§ 371 (c)(1),
(2), (4) Date: Apr. 5, 2006

(87) PCT Pub. No.: WO2005/036276

PCT Pub. Date: Apr. 21, 2005

(65) Prior Publication Data

US 2007/0116496 A1 May 24, 2007

(30) Foreign Application Priority Data

Oct. 8, 2003 (JP) ..... 2003-349620
Oct. 8, 2003 (JP) ..... 2003-349621

(51) Int. Cl.
*G03G 15/01* (2006.01)

(52) U.S. Cl. ..... 399/299

(58) Field of Classification Search ..... 399/39, 399/40, 66, 298, 299, 302, 307; 347/116, 347/117

See application file for complete search history.

(56) References Cited

U.S. PATENT DOCUMENTS 5,765,082 A * 6/1998 Numazu et al. ..... 399/299
6,134,402 A * 10/2000 Nakayama et al. ..... 399/101
6,201,944 B1 * 3/2001 Onuki et al. ..... 399/299
6,963,715 B2 * 11/2005 Kanekura et al. ..... 399/299

FOREIGN PATENT DOCUMENTS

JP 07-333935 12/1995
JP 2574804 10/1996

(Continued)

OTHER PUBLICATIONS

International Search Report for corresponding Application No. PCT/JP2004/014510 mailed Nov. 9, 2004.

*Primary Examiner*—Robert Beatty
(74) *Attorney, Agent, or Firm*—Renner, Otto, Boisselle & Sklar, LLP

(57) ABSTRACT

First eccentric cams for abutting an inner circumferential surface of an intermediate image transferring belt, second eccentric cams for rotating as a unit with the first eccentric cams, cam followers for abutting a circumferential surface of the second eccentric cam, and transmitting members for holding image transferring rollers, moving in response to the cam followers are disposed within a loop-shaped moving path formed by an intermediate image transferring belt, which is stretched across a driving roller and a driven roller. The vertical position of the image transferring rollers, which are held by the transmitting members, changes in accordance with the abutting state of the first eccentric cams with respect to an inner circumferential surface of the intermediate image transferring belt.

21 Claims, 10 Drawing Sheets

FOREIGN PATENT DOCUMENTS

| | | | | |
|---|---|---|---|---|
| JP | 09-138533 | | | 5/1997 |
| JP | 09-274355 | | | 10/1997 |
| JP | 10-039651 | | | 2/1998 |
| JP | 10-293437 | | | 11/1998 |
| JP | 2000-275985 | | | 10/2000 |
| JP | 2000275985 | A | * | 10/2000 |
| JP | 2001-166602 | | | 6/2001 |
| JP | 2002-365928 | | | 12/2002 |
| JP | 2003-107847 | | | 4/2003 |

* cited by examiner

TRANSFER ENDLESS BELT DEVICE APPLIED TO IMAGE FORMING APPARATUS

TECHNICAL FIELD

The present invention relates to tandem-type image forming apparatuses, in which are arranged in a single direction a plurality of image forming portions for forming images of mutually differing colors by electrophotographic image formation, and which can form full color images on a recording medium such as paper via an intermediate image transferring belt or an image transferring carrying belt.

BACKGROUND ART

Demand for full color image forming and not just monochrome image forming has recently grown with respect to electrophotographic image forming apparatuses, and development of electrophotographic full color image forming apparatuses is proceeding. Ordinarily, full color image forming apparatuses form images by using toner of corresponding colors for image data of a plurality of colors in which a color image has undergone color separation. For example, a full color image is formed by reading a color image via filters for colors of the three additive primary colors (red, green, and blue), creating image data for at least the three subtractive primary colors (cyan, magenta, and yellow) from the read data, creating visible images using toner of corresponding colors based on the image data for each color, and overlaying the visible images for each color.

Such full color image forming apparatuses require exposure, developing, and image transfer steps for each color and face problems with aligning the visible images in each color, and are therefore viewed as having an image forming speed for full color images which is slower than an image forming speed for monochrome images.

Tandem-type full color image forming apparatuses have therefore been proposed in the past, in which a semi-conducting endless belt is rotatably provided, a plurality of image forming portions for individually forming visible images of mutually differing colors is disposed in a row along a moving direction of an outer circumferential surface of the endless belt, and one full color image is formed during at least one rotation of the endless belt.

With a tandem-type full color image forming apparatus, full color image formation is made faster by employing an intermediate image transferring method in which the visible images in each color, formed by the image forming portions, are transferred to paper after being overlaid on an outer circumferential surface of the endless belt, or an image transferring carrying method in which the visible images in each color, formed by the image forming portions, are sequentially transferred onto a surface of the recording medium which is carried by adhering to an outer circumferential surface of the endless belt. During full color image formation, an outer circumferential surface of the endless belt in the intermediate image transferring method and a surface of a recording medium which is carried by the endless belt in the image transferring carrying method abut at a predetermined pressure the image bearing members which are individually provided in the image forming portions.

The image transferring carrying method transfers visible images formed by the image forming portions directly to the surface of the recording medium, and therefore has the advantage of only having to perform the image transferring step once for each color, but since the recording medium is carried by the endless belt by being adhered to it, there is not only the disadvantage that a configuration is required for charging the recording medium, but also that the charge of the recording medium affects the transferring of the visible image, causing a deterioration in image formation. In contrast, the intermediate image transferring method has attracted attention because although the step of transferring the images is performed twice for each color, the image formation can be favorably done, as there is no need to charge the recording medium in order to carry it.

On the other hand, while it is true that demand for full color image forming has increased, black color monochrome image formation remains the mainstream, and even faster monochrome image formation is also in demand. Therefore, there is a need to resolve the slowness of monochrome image formation in full color image forming apparatuses due to the use of a plurality of image forming portions provided for full color image formation.

Moreover, during monochrome image formation in a tandem-type full color image forming apparatus, one image forming portion of a plurality of image forming portions forms images, while the remaining image forming portions form no images. There is also a need to prevent the deterioration of image bearing members and the mixing of toner due to contact between the image bearing members and the endless belt or recording medium in image forming portions which are not used for monochrome image formation.

The endless belt becomes deformed when the endless belt is abutted on the image bearing members during standby, when neither monochrome image formation nor full color image formation is performed. Further, any recording medium stuck between the image bearing members and the endless belt cannot be removed when jamming occurs, nor can part replacement or cleaning be performed during maintenance.

Accordingly, configurations have been disclosed which speed up monochrome image formation with conventional tandem-type full color image forming apparatuses, by providing an image forming portion for forming black images in addition to image forming portions for forming images in the three subtractive primary colors, and changing the position of the endless belt with respect to these image forming portions during monochrome image formation and during full color image formation (for example, Patent Documents 1 to 3).

With these conventional configurations, at least one of a driving roller and a driven roller, between which the endless belt is held in tension in order to be driven, is caused to move with respect to the image forming portions. With these configurations, the endless belt can be caused to move without having to give consideration to changes in the circumferential length of the endless belt, since the center distance between the driving roller and the driven roller, across which lies the endless belt in a tensioned condition, is maintained constant during movement of the endless belt.

Patent document 1: JP H10-039651A
Patent document 2: JP H10-293437A
Patent document 3: Japan Patent 2574804

DISCLOSURE OF INVENTION

Problems to be Solved by the Invention

However, in order to distinctly displace the position of the endless belt during monochrome image formation and full color image formation and thereby not adversely affect the image bearing members which are provided in image forming portions which are not used during monochrome image formation in the above conventional configurations, it is necessary to raise significantly the amount by which the driving roller or the driven roller move, entailing the problem of making the apparatus larger.

Furthermore, since the image bearing members provided in the image forming portions and the endless belt are in contact in an image transferring region of a predetermined width called an image transferring nip and the endless belt bends according to a curvature of the surface of the image bearing members, with a configuration in which the center distance between the driving roller and the driven roller is maintained constant, the endless belt sags when separated from the image bearing members which are provided in image forming portions which are not used during monochrome image formation, thereby creating a problem of a meandering endless belt.

The present invention has an object of providing an image forming apparatus capable of contacting and separating an endless belt to and from image bearing members according to the kind of image formation without requiring a larger apparatus or causing the endless belt to meander.

Means for Solving Problem

As a means of solving the problems, the present invention provides an image forming apparatus, comprising:

an endless belt for forming a loop-shaped moving path, stretched out between a driving roller and a driven roller which are affixed to positions inside the apparatus;

a plurality of image bearing members provided in a row within a prescribed range along a moving direction of the endless belt;

a plurality of image transferring members disposed within the moving path and respectively opposed to the image bearing members across the endless belt;

an image transferring member supporting mechanism for approximating and separating the image transferring members to and from the image bearing members; and a belt supporting mechanism for contacting and separating the endless belt to and from the image bearing members in accompaniment of an operation of the image transferring member supporting mechanism.

With this configuration, the endless belt contacts and separates from the image bearing members without displacing the driving roller and the driven roller across which is stretched the endless belt, in accordance with the image transferring members, which are positioned within the loop-shaped moving path formed by the endless belt, approaching to or separating from the image bearing members sandwiching the endless belt. Accordingly, the endless belt contacts or separates from the image bearing members without using a complex mechanism for displacing the driving roller or the driven roller.

Further, the present invention provides an image forming apparatus, comprising:

an endless belt for forming a loop-shaped moving path, stretched out between a driving roller and a driven roller which are affixed to positions inside the apparatus;

a plurality of image bearing members provided in a row within a prescribed range along a moving direction of the endless belt;

a plurality of image transferring members disposed within the moving path and respectively opposed to the image bearing members across the endless belt;

an eccentric cam for rotating at a rotating angle according to the type of image forming operation around a rotating shaft parallel to rotating shafts of the driving roller and the driven roller;

an image transferring member supporting mechanism for converting a change in radius at a specific rotating angle of the eccentric cam to a displacement in a contacting/separating direction with respect to the image bearing members of the image transferring members; and a tension member, latched to the image transferring member supporting mechanism, for deforming the moving path of the endless belt by, moving in response to an operation of the image transferring member supporting mechanism.

With this configuration, when the eccentric cam rotates at a rotating angle corresponding to the type of image forming operation, the change in the radius of the eccentric cam at a specific rotating angle is transmitted to the image transferring members via the image transferring member supporting mechanism, and the image transferring members displace in the contacting/separating direction with respect to the image bearing members while the moving path of the endless belt is deformed by the tension member which moves in response to the image transferring member supporting mechanism. Accordingly, the endless belt contacts and separates from the image bearing members without displacing the driving roller and the driven roller across which is stretched the endless belt, in accordance with the image transferring members, which are positioned within the loop-shaped moving path formed by the endless belt, approaching to or separating from the image bearing members sandwiching the endless belt.

Effects of the Invention

With the present invention, a compact apparatus can be achieved without needing to use a complex mechanism for displacing the driving roller or the driven roller in order to put the moving path of the endless belt in a condition appropriate for the type of image forming operation, since the endless belt can contact and separate from the image bearing members without a displacement of the driving roller and the driven roller, across which the endless belt is stretched, accordingly as the image transferring members positioned within the loop-shaped moving path formed by the endless belt contact and separate from the image bearing members sandwiching the endless belt.

EXPLANATION OF REFERENCE NUMBERS

Figure 1:
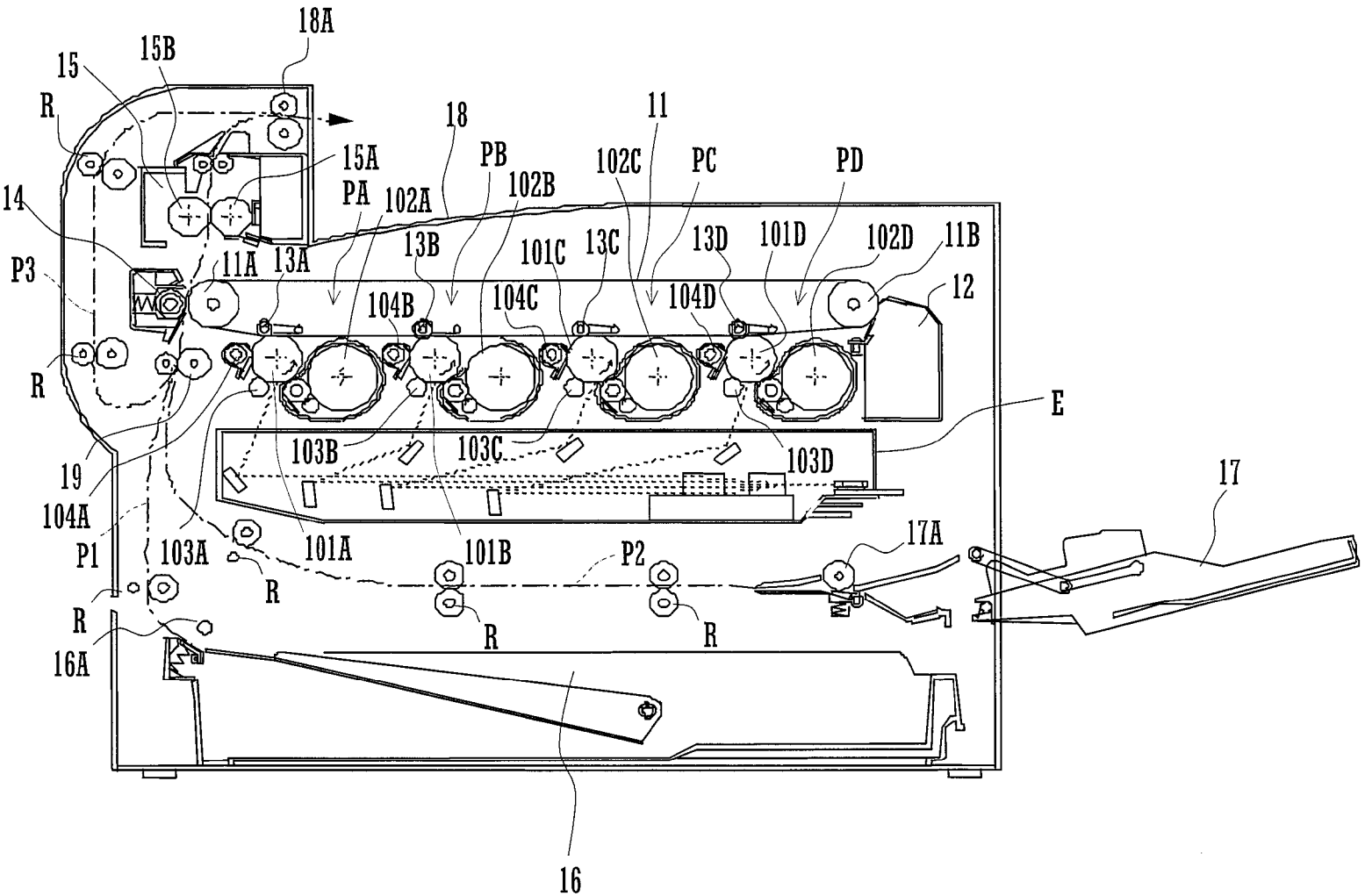
FIG. 1 is an explanatory diagram showing a configuration of an image forming apparatus according to an embodiment of the present invention.

11 Intermediate image transferring belt
11*a* Driving roller
12*b* Driven roller
13*a*-13*d* Image transferring rollers
100 Image forming apparatus
101*a*-110*d* Photosensitive drums
210 Monochrome image moving member
211, 221 First eccentric cams
212, 222 Second eccentric cams
214, 224 Cam followers
215*a*-215*d* Transmitting member
220 Color image moving member
230 Tension member
231 Lever
232 Roller
233 Rotating shaft

BEST MODE FOR CARRYING OUT THE INVENTION

Below follows a detailed description of an image forming apparatus according to an embodiment of the present invention with reference to the drawings.

FIG. 1 is an explanatory diagram showing a configuration of an image forming apparatus according to an embodiment of the present invention. The image forming apparatus 100 forms polychrome and monochrome images on paper and other recording media according to image data transferred from an external source. The image forming apparatus 100 is therefore provided with an exposing unit E, photosensitive drums (equivalent to image bearing members of the present invention) 101A through 101D, developing units 102A through 102D, charging rollers 103A through 103D, cleaning units 104A through 104D, an intermediate image transferring belt (equivalent to an endless belt of the present invention) 11, intermediate image transferring rollers (equivalent to image transferring members of the present invention; hereafter simply called image transferring rollers) 13A through 13D, a secondary image transferring roller 14, a fixing device 15, paper carrying paths P1, P2, and P3, a paper feeding cassette 16, a manual paper feeding tray 17, an ejection tray 18, and so on.

The image forming apparatus 100 forms images using image data corresponding to each of four colors, which are the three primary subtractive colors cyan (C), magenta (M), and yellow (Y), to which is added black (K), achieved through color separation of a color image. Four each of the photosensitive drums 101A through 101D, the developing units 102A through 102D, the charging rollers 103A through 103D, the image transferring rollers 13A through 13D, and the cleaning units 104A through 104D are provided for each color, thus making up four image forming portions PA through PD. The image forming portions PA through PD are arranged in a row in a moving direction (a sub scanning direction) of the intermediate image transferring belt 11.

The charging rollers 103 are contact-type charging devices for charging to a uniform potential surfaces of the photosensitive drums 101. Contact-type charging devices which use charging brushes or non-contact-type charging devices which use chargers may be used in lieu of the charging rollers 103. The exposing unit E is provided with a semiconductor laser, a polygonal mirror, a reflecting mirror, and so on, which are not shown in the drawings, and irradiates the photosensitive drums 101A through 101D with laser beams modulated by image data for the black, cyan, magenta, and yellow colors, thus forming latent images on surfaces of the photosensitive drums 101A through 101D according to image data. Latent images are formed on the photosensitive drums 101A through 101D according to image data of the black, cyan, magenta, and yellow colors.

Accordingly, the photosensitive drum 101A is the image bearing member for monochrome images of the present invention on which are formed black toner images during formation of monochrome images, and the photosensitive drums 101B through 101D are the image bearing members for color images of the present invention on which are formed toner images in the three subtractive primary colors during formation of full color images.

The developing units 102 develop latent images into toner images by supplying developer to surfaces of the photosensitive drums 101 on which latent images are formed. The developing units 102A through 102D respectively contain developer of the black, cyan, magenta, and yellow colors, and develop latent images of respective colors formed on the photosensitive drums 101A through 101D into toner images in the black, cyan, magenta, and yellow colors. The cleaning units 104A through 104D eliminate and collect toner remaining on surfaces of the photosensitive drums 101A through 101D after developing and image transfer.

The intermediate image transferring belt 11, which is disposed above the photosensitive drums 101A through 101D, is stretched across the driving roller 11A and the driven roller 11B in a tensioned condition and forms a loop-shaped moving path. An outer circumferential surface of the intermediate image transferring belt 11 opposes the photosensitive drum 101D, the photosensitive drum 101C, the photosensitive drum 101B, and the photosensitive drum 101A, in this order. The image transferring rollers 13A through 13D are disposed in positions opposing the photosensitive drums 101A through 101D with the intermediate image transferring belt 11 interposed therebetween. An image transferring bias is applied to the image transferring rollers 13A through 13D of the opposite polarity of that of the toner charge, in order to transfer toner images held on surfaces of the photosensitive drums 101A through 101D to the intermediate image transferring belt 11. Accordingly, the toner images in each color which are formed on the photosensitive drums 101A through 101D are transferred sequentially in overlay onto the outer circumferential surface of the intermediate image transferring belt 11, a full color toner image thereby being formed on the outer circumferential surface of the intermediate image transferring belt 11.

Note, however, that if image data containing only part of cyan, magenta, yellow, and black colors is input, a latent image or a toner image is formed only on corresponding one(s) of the photosensitive drums 101A through 101D to the color(s) contained in the input image data. For example, when forming monochrome images, latent image formation and toner image formation is only performed on the photosensitive drum 101A which corresponds to the black color, and only a black toner image is transferred to the outer circumferential surface of the intermediate image transferring belt 11.

The image transferring rollers 103A through 103D consist of a metal (e.g., stainless steel) shaft with a diameter of 8 to 10 mm whose surface is covered with a conductive elastic material (e.g., EPDM, urethane foam, etc.), and apply a uniform high voltage to the intermediate image transferring belt 11 using the conductive elastic material. A brush-type intermediate image transferring member may be used in lieu of the image transferring rollers 103.

As described above, toner images formed on the outer circumferential surface of the intermediate image transferring belt 11 are carried to a position opposing the secondary image transferring roller 14 through rotation of the intermediate image transferring belt 11. The secondary image transferring roller 14 presses on the outer circumferential surface of the intermediate image transferring belt 11 with the predetermined nip pressure during image formation. When paper which is fed from the paper feeding cassette 16 or the manual paper feeding tray 17 passes between the secondary image transferring roller 14 and the intermediate image transferring belt 11, a high voltage is applied to the secondary image transferring roller 14 with a polarity opposite that of the polarity of the charge of the toner. A toner image is thereby transferred to a surface of the paper from the outer circumferential surface of the intermediate image transferring belt 11.

Note that in order to maintain the nip pressure between the secondary image transferring roller 14 and the intermediate image transferring belt 11 at the predetermined value, either the secondary image transferring roller 14 or the intermediate image transferring belt 11 consists of a hard material (e.g., metal) while the other consists of a soft material such as an elastic roller (e.g., elastic rubber rollers, expandable resin rollers, etc.).

Toner remaining on the intermediate image transferring belt 11 which was not transferred to the paper, of the toner attached to the intermediate image transferring belt 11 from the photosensitive drums 101A through 101D is collected by the cleaning units 12 in order to prevent mixing in subsequent steps.

The paper onto which the toner image has been transferred is guided to the fixing device 15 and receives heat and pressure by passing between a heating roller 15A and a pressurizing roller 15B. The toner image is thereby thoroughly fixed to the surface of the paper. The paper onto which the toner image has been fixed is ejected to the paper ejection tray 18 by an ejecting roller 18A.

The image forming apparatus 100 is provided with the paper carrying path P1 for sending the paper, which is contained in a paper cassette 16, to the ejection tray 18 passing between the secondary image transferring roller 14 and the intermediate image transferring belt 11 and the fixing device 15. Along the paper carrying path P1 are disposed a pick up roller 16A for feeding the paper which is in the paper cassette 16 into the paper carrying path P1 one sheet at a time, a carrying roller R for carrying upwards the paper which has been fed, a registration roller 19 for guiding the carried paper between the secondary image transferring roller 14 and the intermediate image transferring belt 11 at a predetermined timing, and a paper ejecting roller 18A for ejecting the paper to the ejection tray 18.

Inside the image forming apparatus 100, the paper carrying path P2 is formed between the manual paper feeding tray 17 and the registration roller 19, and along which are disposed the pick up roller 17A and the carrying roller R. Further, the paper carrying path P3 is formed from the paper ejecting roller 18A to an upstream side of the registration roller 19 on the paper carrying path P1.

The paper ejecting roller 18A is provided rotatably forward and backward, and ejects paper to the ejection tray 18, driven in a forward direction during single surface image formation in which an image is formed on a single surface of the paper and when forming an image on a second surface during double surface image formation in which images are formed on both surfaces of the paper. On the other hand, when forming images on a first surface during double surface image formation, the ejecting roller 18A is driven forward until the bottom end of the paper passes the fixing device 15 and then guides the paper into the paper carrying path P3, driven in the backward direction while holding the bottom end of the paper. The paper, only one side of which an image has been formed during double surface image formation, is thereby guided to the paper carrying path P1, its top and bottom surfaces and its top and bottom ends reversed.

The registration roller 19 guides the paper, which has been fed from the paper cassette 16 or the manual paper feeding tray 17 and carried via the paper carrying path P3, between the secondary image transferring roller 14 and the intermediate image transferring belt 11 in a timing synchronized to rotation of the intermediate image transferring belt 11. For this reason, the registration roller 19 therefore stops rotating when the photosensitive drums 101A through 101D or the intermediate image transferring belt 11 begin operation, and the paper fed or sent ahead by rotation of the intermediate image transferring belt 11 stops moving inside the paper carrying path P1, with its bottom end abutting the registration roller 19. Thereafter, the registration roller 19 begins rotation in a timing in which the front end portion of the paper is in opposition to the front end portion of the toner image formed on the intermediate image transferring belt 11 at a position at which the secondary image transferring roller 14 and the intermediate image transferring belt 11 are abutted with pressure.

Figure 2:
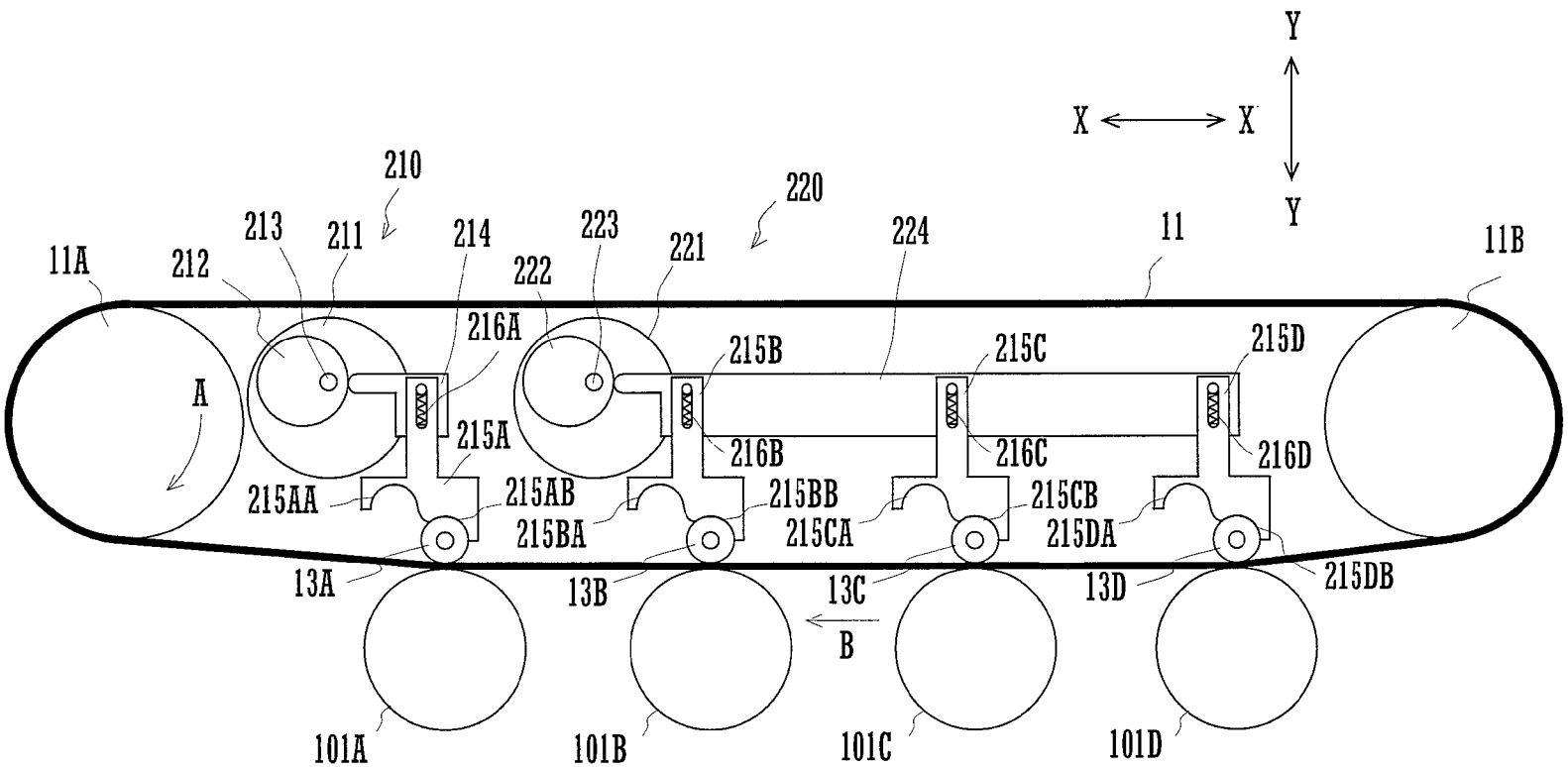
FIG. 2 is a view showing a configuration of an image transferring member supporting mechanism and a belt supporting mechanism provided in the image forming apparatus.

FIG. 2 is a view showing a configuration of an image transferring member supporting mechanism and a belt supporting mechanism which are provided in the image forming apparatus according to a first embodiment of the present invention. The intermediate image transferring belt 11 forms a loop-shaped moving path including approximately level upper and lower ranges, being stretched across the driving roller 11A and the driven roller 11B. The photosensitive drums 101A through 101D of the image forming stations PA through PD are disposed below the intermediate image transferring belt 11. The photosensitive drums 101A through 101D are provided side by side in a row arrangement along the lower range of the moving path of the intermediate image transferring belt 11, and the outer circumferential surface of the intermediate image transferring belt 11 opposes the photosensitive drums 101A through 101D in the lower range of the moving path. Intermediate image transferring belt 11 moves in the direction of the arrow B in the lower range of the moving path due to rotation in the direction of the arrow A of the driving roller 11A.

The image transferring rollers (equivalent to the image transferring members of the present invention) 13A through 13D, which are included in the image forming stations PA through PD, are disposed within the loop-shaped moving path of the intermediate image transferring belt 11. The image transferring rollers 13A through 13D are supported by a shaft so as to be movable in a vertical direction (the Y-Y direction) at a position opposing the photosensitive drums 101A through 101D with the intermediate image transferring belt 11 interposed therebetween. Accordingly, the image transferring rollers 13A through 13D approach to and separate from the photosensitive drums 101A through 101D. The image transferring rollers 13A through 13D apply a predetermined elastic force upward.

First eccentric cams 211 and 221 as the belt supporting mechanism of the present invention, and second eccentric cams 212 and 222 , cam followers 214 and 224, and transmitting members 215A through 215D as the image transferring member supporting mechanism of the present invention are disposed within the loop-shaped moving path of the intermediate image transferring belt 11. The second eccentric cam 212, the cam follower 214, and the transmitting member 215A make up a monochrome image moving member 210 of the present invention, and the second eccentric cam 222, the cam follower 224, and the transmitting members 215B through 215D make up a color image moving member 220 of the present invention. The first eccentric cam 211 and the second eccentric cam 212 rotate as a unit around an identical rotating shaft 213. The first eccentric cam 221 and the second eccentric cam 222 rotate as a unit around an identical rotating shaft 223. The rotating shafts 213 and 223 are disposed parallel to rotating shafts of the driving roller 11A and the driven roller 11B.

In the monochrome image moving member 210, the cam follower 214 is provided movably in the horizontal direction (the X-X direction) and an end portion of the cam follower 214 abuts a circumferential surface of the second eccentric cam 212. The cam follower 214 is biased by an elastic force of an elastic member which is not shown in the drawings toward the second eccentric cam 212. The transmitting member 215A is supported by the cam follower 214 so as to be vertically movable, and is biased downward by an elastic force of a spring 216A. In the transmitting member 215A, a concave portion 215AA (equivalent to a second holding portion of the present invention) and a concave portion 215AB (equivalent to a first holding portion of the present invention) for supporting the image transferring roller 13A, which is included in the black image forming station PA, from above are formed at vertically and horizontally different positions.

When the distance from the rotating shaft 213 to the circumferential surface of the second eccentric cam 212 changes due to rotation of the second eccentric cam 212, the cam follower 214 is displaced horizontally together with the transmitting member 215A and either one of the concave portion 215AA and the concave portion 215AB of the transmitting member 215A is selectively positioned above the image transferring roller 13A. The concave portion 215AA and the concave portion 215AB are formed at vertically different positions in the transmitting member 215A. The image transferring roller 13A is biased upward. Accordingly, the vertical position of the image transferring roller 13A is determined by the transmitting member 215A, the vertical position of the image transferring roller 13A changes in accordance with whether the concave portion 215AA or the concave portion 215AB is positioned above the image transferring roller 13A by the rotation of the second eccentric cam 212, and the image transferring roller 13A approaches or separates from the photosensitive drum 101A, which is the image bearing member for monochrome images.

The cam follower 224 is provided movably in the horizontal direction in the color image moving member 220 and an end portion of the cam follower 224 abuts a circumferential surface of the second eccentric cam 222. The cam follower 224 is biased by an elastic force of an elastic member which is not shown in the drawings toward the second eccentric cam 222. The transmitting members 215B through 215D are supported by the cam follower 224 so as to be vertically movable, and are biased downward by an elastic force of springs 216B through 216D. In the transmitting members 215B through 215D, concave portions 215BA and 215BB through 215DA and 215DB, which support from above the image transferring rollers 13B through 13D, which are included in the image forming stations PB through PD for the cyan, magenta, and yellow colors, are formed at vertically and horizontally different positions. The concave portions 215BA, 215CA, and 215DA are equivalent to the second holding portion of the present invention and the concave portions 215BB, 215CB, and 215DB are equivalent to the first holding portion of the present invention.

When the distance from the rotating shaft 223 to the circumferential surface of the second eccentric cam 222 changes due to rotation of the second eccentric cam 222, the cam follower 224 displaces horizontally together with the transmitting members 215B through 215D and either the concave portions 215BA through 215DA or concave portions 215BB through 215DB of the transmitting members 215B through 215D is selectively positioned above the image transferring rollers 13B through 13D. The concave portions 215BA through 215DA and the concave portions 215BB through 215DB are formed at vertically different positions in the transmitting members 215B through 215D. The image transferring rollers 13B through 13D are biased upward. Accordingly, the vertical positions of the image transferring rollers 13B through 13D are determined by the transmitting members 215B through 215D, the vertical positions of the image transferring rollers 13B through 13D change in accordance with whether the concave portions 215BA through 215DA or the concave portions 215BB through 215DB are positioned above the image transferring rollers 13B through 13D by the rotation of the second eccentric cam 212, and the image transferring rollers 13B through 13D approach or separate from the photosensitive drums 101B through 10D, which are the image bearing members for color images.

The first eccentric cam 211 (the monochrome image supporting member) and the first eccentric cam 221 (the color image supporting member) rotate as a unit with the second eccentric cams 212 and 222 around the rotating shafts 213 and 223. The rotating shafts 213 and 223 are disposed proximally to an inner surface in the upper range of the loop-shaped moving path of the intermediate image transferring belt 11. By rotating, circumferential surfaces of the first eccentric cams 211 and 221 selectively contact the inner surface of the intermediate image transferring belt 11 in the upper range of the moving path of the intermediate image transferring belt 11. Accordingly, the circumferential surfaces of the first eccentric cams 211 and 221 selectively contact the inner surface of the intermediate image transferring belt 11 according to vertical movements of the image transferring rollers 13A through 13D due to the rotation of the second eccentric cams 212 and 222.

Figure 3A:
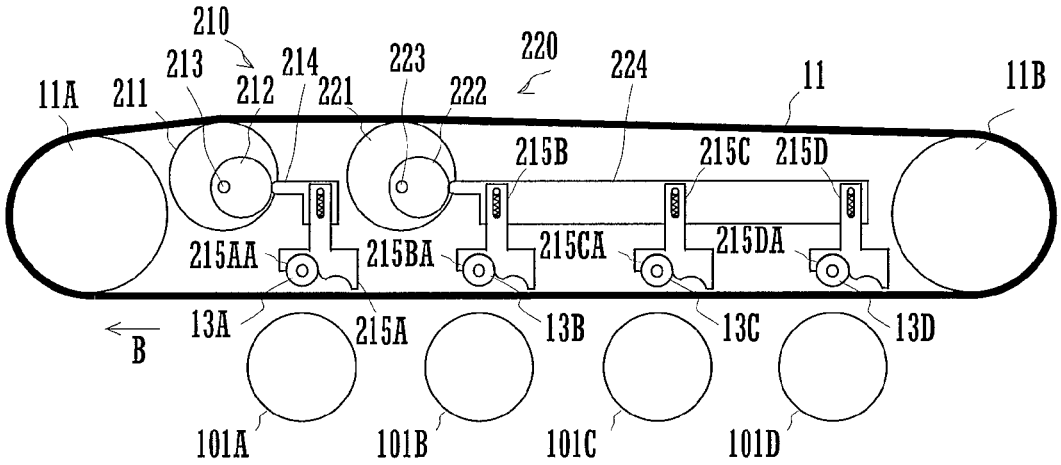
FIGS. 3A to 3C are views showing a moving path of an intermediate image transferring belt in the image forming apparatus.
Figure 3B:
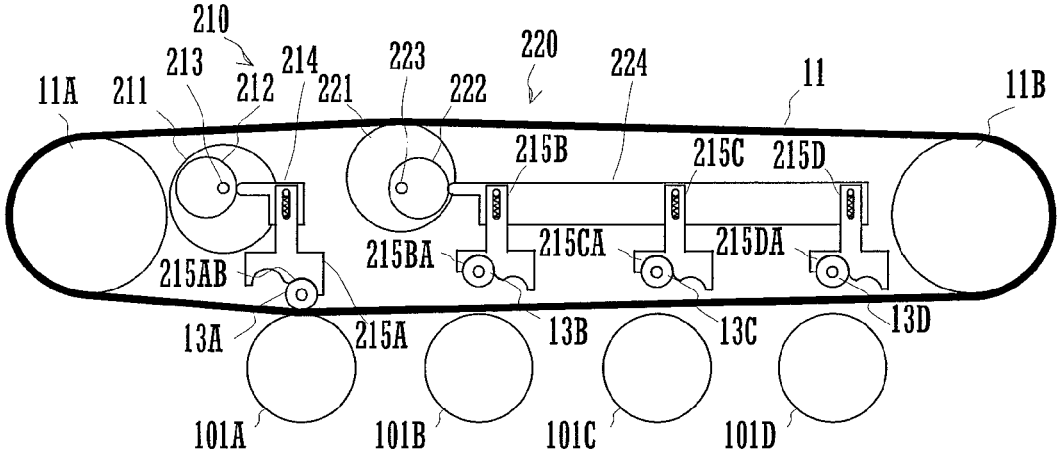

FIGS. 3A to 3B are views showing a moving path of the intermediate image transferring belt in the image forming apparatus. FIG. 3A shows a first path which is the moving path while an image forming operation of the intermediate image transferring belt 11 of the image forming apparatus 100 is in standby. While an image forming operation is in standby, in the monochrome image moving member 210, the cam follower 214 abuts the portion furthest from the rotating shaft 213 on a circumferential surface of the second eccentric cam 212, the concave portion 215AA on the upper side of the transmitting member 215A is positioned above the image transferring roller 13A, and the image transferring roller 13A separates from the photosensitive drum 101A and the intermediate image transferring belt 11. At the same time, the portion furthest from the rotating shaft 213 on the circumferential surface of the first eccentric cam 211, which is the monochrome image supporting member, is positioned vertically above the rotating shaft 213, abuts the inner surface of the intermediate image transferring belt 11, and lifts the intermediate image transferring belt 11 upward.

Furthermore, while an image forming operation is in standby, in the color image moving member 220, the cam follower 224 abuts the portion furthest from the rotating shaft 223 on a circumferential surface of the second eccentric cam 222, the concave portions 215BA through 215DA on the upper side of the transmitting members 215B through 215D are positioned above the image transferring rollers 13B through 13D, and the image transferring rollers 13B through 13D separate from the photosensitive drums 101B through 101D and the intermediate image transferring belt 11. At the same time, the portion furthest from the rotating shaft 223 on the circumferential surface of the first eccentric cam 221, which is the color image supporting member, is positioned vertically above the rotating shaft 223, abuts the inner surface of the intermediate image transferring belt 11, and lifts the intermediate image transferring belt 11 upward.

Accordingly, while an image forming operation is in standby, the intermediate image transferring belt 11 is pushed upward by the first eccentric cams 211 and 221 in the upper range of the moving path, and because the image transferring rollers 13A through 13D are separated upward with respect to the lower range of the moving path, the intermediate image transferring belt 11 becomes level from the time it separates from the circumferential surface of the driven roller 11B until it contacts the circumferential surface of the driving roller 11A in the lower range of the moving path, and the intermediate image transferring belt 11 does not contact any of the photosensitive drums 101A through 101D or the image transferring rollers 13A through 13D.

FIG. 3B shows a third path which is the moving path of the intermediate image transferring belt 11 of the image forming apparatus 100 while forming monochrome images. While forming monochrome images, in the monochrome image moving member 210, the cam follower 214 abuts the portion closest to the rotating shaft 213 on the circumferential surface of the second eccentric cam 212, the concave portion 215AB on the lower side of the transmitting member 215A is positioned above the image transferring roller 13A, and the image transferring roller 13A is close to the photosensitive drum 101A and actually abuts the photosensitive drum 101A with the intermediate image transferring belt 11 sandwiched. At the same time, the portion closest to the rotating shaft 213 on the circumferential surface of the first eccentric cam 211, which is the monochrome image supporting member, is positioned vertically above the rotating shaft 213 and separates from the inner surface of the intermediate image transferring belt 11.

Furthermore, while forming monochrome images, in the color image moving member 220, the cam follower 224 abuts the portion furthest from the rotating shaft 223 on a circumferential surface of the second eccentric cam 222, the concave portions 215BA through 215DA on the upper side of the transmitting members 215B through 215D are positioned above the image transferring rollers 13B through 13D, and the image transferring rollers 13B through 13D separate from the photosensitive drums 101B through 101D and the intermediate image transferring belt 11. At the same time, the portion furthest from the rotating shaft 223 on the circumferential surface of the first eccentric cam 221, which is the color image supporting member is positioned vertically above the rotating shaft 223, abuts the inner surface of the intermediate image transferring belt 11, and lifts the intermediate image transferring belt 11 upward.

Accordingly, during formation of monochrome images, the intermediate image transferring belt 11 is pushed upward by the first eccentric cam 221 in the upper range of the moving path of the intermediate image transferring belt 11, and the intermediate image transferring belt 11 abuts the photosensitive drum 101A via the image transferring roller 13A in the lower range of the moving path of the intermediate image transferring belt 11, while the image transferring rollers 13B through 13D separate upward away from the intermediate image transferring belt 11. Therefore, when the intermediate image transferring belt 11 separates from the circumferential surface of the driven roller 11B in the lower range of the moving path, it abuts the photosensitive drum 101A and the circumferential surface of the image transferring roller 13A and then contacts the circumferential surface of the driving roller 11A, without contacting the photosensitive drums 101B through 101D or the image transferring rollers 13B through 13D.

Figure 3C:
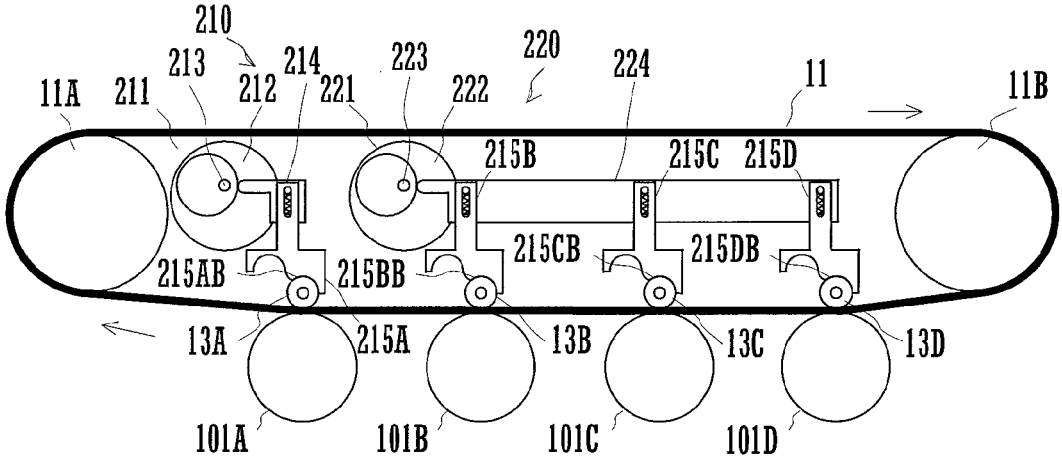

FIG. 3C shows a second path which is the moving path of the intermediate image transferring belt 11 of the image forming apparatus 100 while forming full color images. While forming full color images, in the monochrome image moving member 210, the cam follower 214 abuts the portion closest to the rotating shaft 213 on the circumferential surface of the second eccentric cam 212, the concave portion 215AB on the lower side of the transmitting member 215A is positioned above the image transferring roller 13A, and the image transferring roller 13A is close to the photosensitive drum 101A and actually abuts the photosensitive drum 101A with the intermediate image transferring belt 11 sandwiched. At the same time, the portion closest to the rotating shaft 213 on the circumferential surface of the first eccentric cam 211, which is the monochrome image supporting member, is positioned vertically above the rotating shaft 213 and separates from the inner surface of the intermediate image transferring belt 11.

Further, while forming full color images, in the color image moving member 220, the cam follower 224 abuts the portion closest to the rotating shaft 223 on the circumferential surface of the second eccentric cam 222, the concave portions 215BB through 215DB on the lower side of the transmitting members 215B through 215D are positioned above the image transferring rollers 13B through 13D, and the image transferring rollers 13B through 13D are close to, and actually abut, the photosensitive drums 101B through 101D, sandwiching the intermediate image transferring belt 11. At the same time, the portion closest to the rotating shaft 223 on the circumferential surface of the first eccentric cam 221, which is the color image supporting member, is positioned vertically above the rotating shaft 223 and separates from the inner surface of the intermediate image transferring belt 11.

Accordingly, when forming full color images, the intermediate image transferring belt 11 does not contact either of the first eccentric cams 211 or 221 from the time it separates from the circumferential surface of the driving roller 11A until it reaches the circumferential surface of the driven roller 11B in the upper range of the moving path of the intermediate image transferring belt 11, and the intermediate image transferring belt 11 moves level. The intermediate image transferring belt 11 abuts all the photosensitive drums 101A through 101D by the image transferring rollers 13A through 13D in the lower range of the moving path of the intermediate image transferring belt 11. Therefore, when the intermediate image transferring belt 11 separates from the circumferential surface of the driven roller 11B in the lower range of the moving path, it abuts the circumferential surfaces of the photosensitive drums 101A through 101D and the image transferring rollers 13A through 13D and then contacts the circumferential surface of the driving roller 11A.

In this way, with the image forming apparatus 100, the moving path of the intermediate image transferring belt 11 selectively changes to any of the first through third paths based on the rotation of the first eccentric cams 211 and 221 and the second eccentric cams 212 and 222 in accordance with the type of image forming operation. Since the intermediate image transferring belt 11 does almost not expand or contract with respect to the moving direction, the shape of the first eccentric cams 211 and 221 and the positions of the rotating shafts 213 and 223 are determined such that the total length of the moving path of the intermediate image transferring belt 11 for any of the first through the third paths is always maintained constant.

Figure 4:
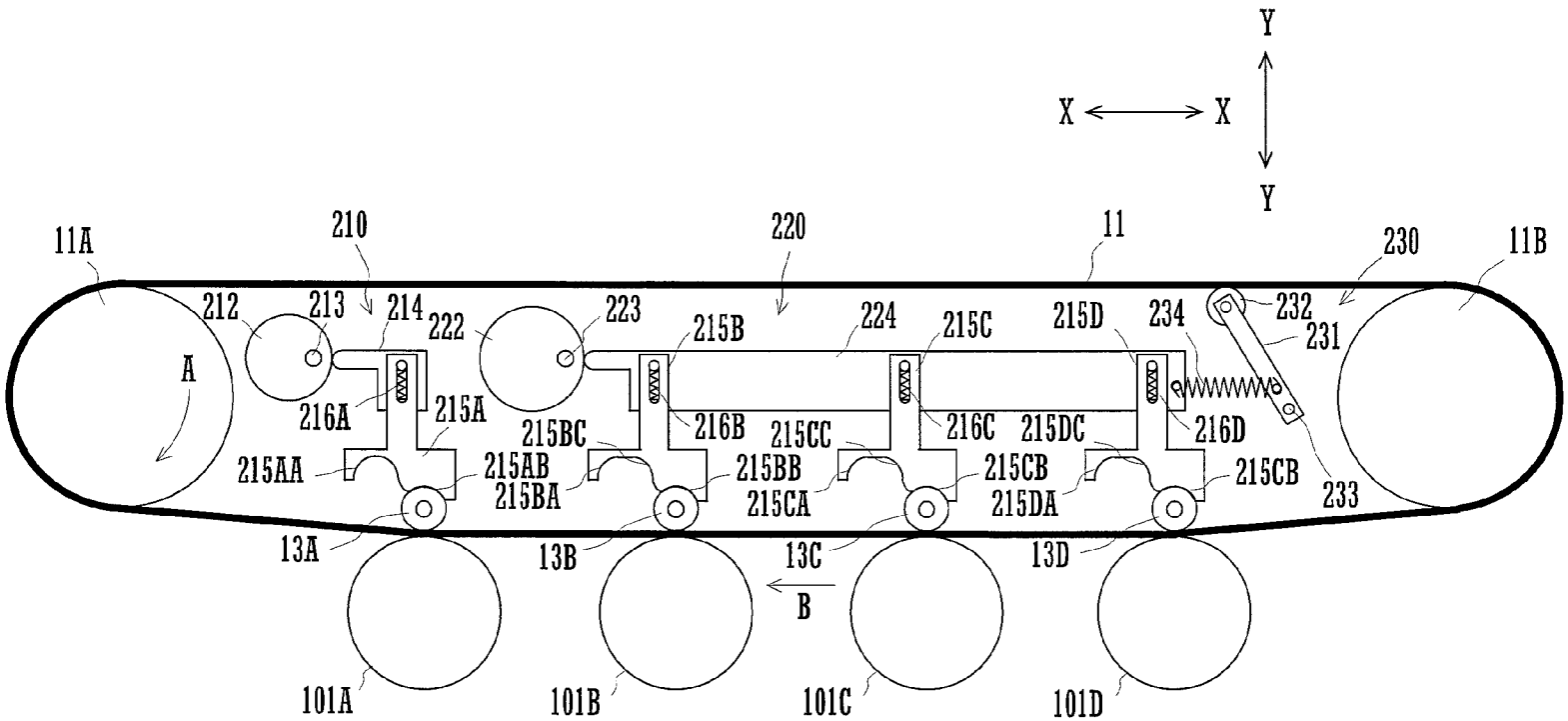
FIG. 4 is a view showing a configuration of the image transferring member supporting mechanism and the belt supporting mechanism provided in the image forming apparatus.

FIG. 4 is a view showing a configuration of an image transferring member supporting mechanism and a belt supporting mechanism which are provided in the image forming apparatus according to a second embodiment of the present invention. The intermediate image transferring belt 11 forms a loop-shaped moving path including approximately level upper and lower ranges, being stretched across the driving roller 11A and the driven roller 11B. The photosensitive drums 101A through 101D of the image forming stations PA through PD are disposed below the intermediate image transferring belt 11. The photosensitive drums 101A through 101D are provided side by side in a row arrangement along the lower range of the moving path of the intermediate image transferring belt 11, and the outer circumferential surface of the intermediate image transferring belt 11 opposes the photosensitive drums 101A through 101D in the lower range of the moving path. Intermediate image transferring belt moves in the direction of the arrow B in the lower range of the moving path due to rotation in the direction of the arrow A of the driving roller 11A.

The image transferring rollers 13A through 13D, which are included in the image forming stations PA through PD, are disposed within the loop-shaped moving path of the intermediate image transferring belt 11. The image transferring rollers 13A through 13D are supported by shafts so as to be movable in a vertical direction (the Y-Y direction) at a position opposing the photosensitive drums 101A through 101D sandwiching the intermediate image transferring belt 11. Accordingly, the image transferring rollers 13A through 13D approach to and separate from the photosensitive drums 101A through 101D. The image transferring rollers 13A through 13D apply a predetermined elastic force upward.

The eccentric cams 212 and 222, the tension member 230, and, as the image transferring member supporting mechanism of the present invention, the cam followers 214 and 224 and the transmitting members 215A through 215D are disposed within the loop-shaped moving path of the intermediate image transferring belt 11. The cam follower 214 and the transmitting member 215A make up a monochrome image moving member 210 of the present invention, and the cam follower 224 and the transmitting members 215B through 215D make up a color image moving member 220 of the present invention. The eccentric cam 212 rotates around the rotating shaft 213. The eccentric cam 222 rotates around the rotating shaft 223. The rotating shafts 213 and 223 are disposed parallel to rotating shafts of the driving roller 11A and the driven roller 11B.

The tension member 230 axially supports a roller 232 at one end portion and is made up of a lever 231 which is swingable around the rotating shaft 233 at another end portion. An end portion of a coil spring (equivalent to the elastic member of the present invention), another end portion of which is latched to the cam follower 224, is latched to a central portion of the lever 231. Accordingly, the lever 231 is latched to the cam follower via the coil spring 234. A circumferential surface of the roller 232 abuts the inner circumferential surface of the intermediate image transferring belt 11 in the upper range of the moving path of the intermediate image transferring belt 11.

In the monochrome image moving member 210, the cam follower 214 is provided movably in the horizontal direction (the X-X direction), and the abutting portion of the cam follower 214 abuts a circumferential surface of the eccentric cam 212 at a horizontal rotating angle position of the eccentric cam 212. The cam follower 214 is biased by an elastic force of an elastic member which is not shown in the drawings toward the eccentric cam 212. The transmitting member 215A is supported by the cam follower 214 so as to be vertically movable, and is biased downward by an elastic force of a spring 216A. The concave portion 215AA and the concave portion 215AB, which support from above the image transferring roller 13A which is included in the black image forming station PA, are formed at vertically and horizontally different positions in the transmitting member 215A.

When the distance from the rotating shaft 213 to the circumferential surface of the eccentric cam 212 (the length of the radius on the side of the cam follower 214 at a horizontal rotating angle of the eccentric cam 212) changes due to rotation of the eccentric cam 212, the cam follower 214 displaces horizontally together with the transmitting member 215A and either one of the concave portion 215AA and the concave portion 215AB of the transmitting member 215A is selectively positioned above the image transferring roller 13A. The concave portion 215AA and the concave portion 215AB are formed at vertically different positions in the transmitting member 215A. The image transferring roller 13A is biased upward. Accordingly, the vertical position of the image transferring roller 13A is determined by the transmitting member 215A, the vertical position of the image transferring roller 13A changes in accordance with whether the concave portion 215AA or the concave portion 215AB is positioned above the image transferring roller 13A by the rotation of the eccentric cam 212, and the image transferring roller 13A approach or separates from the photosensitive drum 101A, which is the image bearing member for monochrome images.

The cam follower 224 is provided movably in the horizontal direction in the color image moving member 220 and the abutting portion of the cam follower 224 abuts a circumferential surface of the eccentric cam 222 at a horizontal direction rotating angle position of the eccentric cam 222. The cam follower 224 is biased by an elastic force of an elastic member which is not shown in the drawings toward the eccentric cam 222. The transmitting members 215B through 215D are movably supported vertically by the cam follower 224, and are biased downward by an elastic force of springs 216B through 216D. In the transmitting members 215B through 215D, concave portions 215BA, 215BB, and 215BC through 215DA, 215DB, and 215DC, which support from above the image transferring rollers 13B through 13D, which are included in the image forming stations PB through PD for the cyan, magenta, and yellow colors, are formed at vertically and horizontally different positions.

When the distance from the rotating shaft 223 to the circumferential surface of the eccentric cam 222 (the length of the radius on the side of the cam follower 224 at a horizontal rotating angle of the eccentric cam 212) changes due to rotation of the eccentric cam 222, the cam follower 224 displaces horizontally together with the transmitting members 215B through 215D and either the concave portions 215BA through 215DA, the concave portions 215BB through 215DB or the concave portions 215BC through 215DC of the transmitting members 215B through 215D are selectively positioned above the image transferring rollers 13B through 13D. The concave portions 215BA through 215DA and the concave portions 215BC through 215DC, and the concave portions 215BB through 215DB are formed at vertically different positions in the transmitting members 215B through 215D. The image transferring rollers 13B through 13D is biased upward. Accordingly, the vertical positions of the image transferring rollers 13B through 13D are determined by the transmitting members 215B through 215D, the vertical positions of the image transferring rollers 13B through 13D change in accordance with whether the concave portions 215BA through 215DA or the concave portions 215BC through 215DC, or the concave portions 215BB through 215DB are positioned above the image transferring rollers 13B through 13D by the rotation of the eccentric cam 212, and the image transferring rollers 13B through 13D approach or separate from the photosensitive drums 101B through 101D, which are the image bearing members for color images.

The horizontal displacement of the cam follower 224 due to rotation of the eccentric cam 222 is transmitted to the lever 231 via the coil spring 234, and the when the eccentric cam 222 rotates, the lever 231 swings around the rotating shaft 233. When the lever 231 swings around the rotating shaft 233 the vertical position of the roller 232 changes in response to the swing angle of the lever 231. The circumferential surface of the roller 232 abuts the inner circumferential surface of the intermediate image transferring belt 11 in the upper range of the moving path of the intermediate image transferring belt 11, so the moving path of the intermediate image transferring belt 11 deforms when the vertical position of the roller 232 changes.

Accordingly, when the cam follower 224 displaces horizontally together with the transmitting members 215B through 215D due to the rotation of the eccentric cam 222, the swing angle of the lever 231 changes and the moving path of the intermediate image transferring belt 11 deforms in response to whether the concave portions 215BA through 215DA, the concave portions 215BC through 215DC, or the concave portions 215BB through 215DB are positioned above the image transferring rollers 13B through 13D.

Figure 5A:
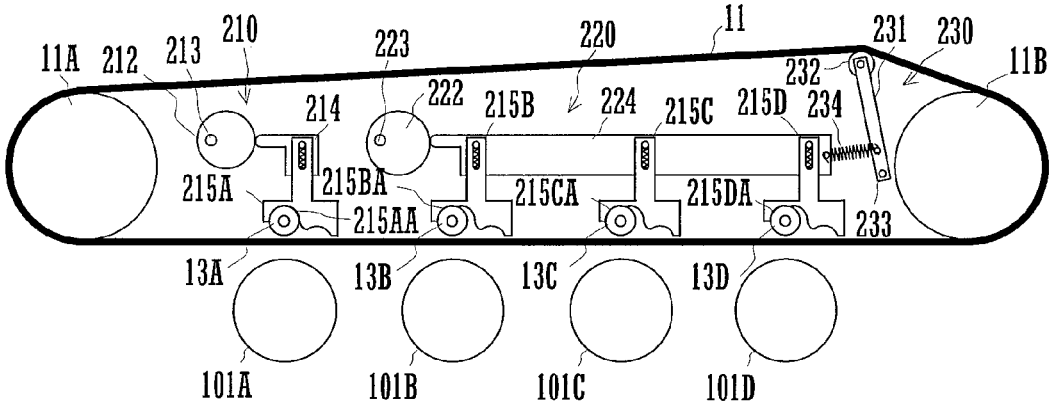
FIGS. 5A to 5C are views showing a moving path of the intermediate image transferring belt in the image forming apparatus.
Figure 5B:
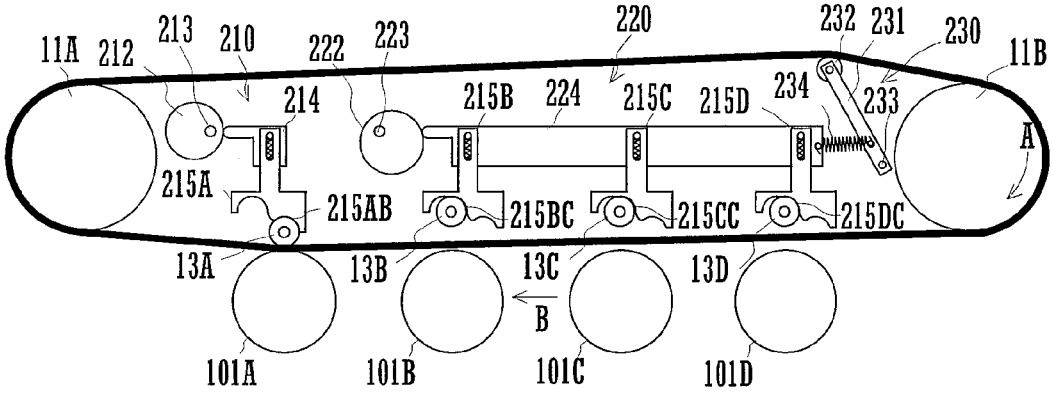
Figure 5C:
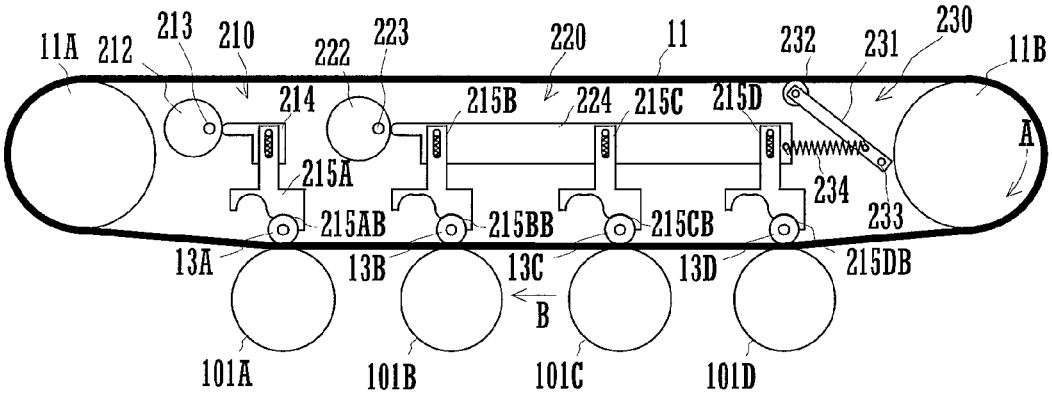

FIGS. 5A to 5C are views showing the moving path of the intermediate image transferring belt in the image forming apparatus. FIG. 5A shows a first path which is the moving path while an image forming operation of the intermediate image transferring belt 11 of the image forming apparatus 100 is in standby. While an image forming operation is in standby, in the monochrome image moving member 210, the cam follower 214 abuts the portion furthest from the rotating shaft 213 on a circumferential surface of the eccentric cam 212 (the portion at which the radius is longest), the concave portion 215AA on the upper side of the transmitting member 215A is positioned above the image transferring roller 13A, and the image transferring roller 13A separates from the photosensitive drum 101A and the intermediate image transferring belt 11.

Furthermore, while an image forming operation is in standby, in the color image moving member 220, the cam follower 224 abuts the portion (the portion at which the radius is longest) furthest from the rotating shaft 223 on a circumferential surface of the eccentric cam 222, and because the cam follower 224 is positioned furthest to the right within a horizontal moving range, the concave portions 215BA through 215DA on the upper side of the transmitting members 215B through 215D are positioned above the image transferring rollers 13B through 13D, and the image transferring rollers 13B through 13D separate from the photosensitive drums 101B through 101D and the intermediate image transferring belt 11. At the same time, the tilt angle from vertical of the lever 231 on the tension member 230 becomes smallest, the roller 232 is positioned at the highest position, and part of the upper range of the moving path of the intermediate image transferring belt 11 protrudes furthest upward.

Accordingly, while an image forming operation is in standby, the intermediate image transferring belt 11 is pushed furthest upward by the roller 232 on the tension member 230 in the upper range of the moving path, and because the image transferring rollers 13A through 13D are separated upward with respect to the lower range of the moving path, the intermediate image transferring belt 11 becomes level in the lower range of the moving path, and the intermediate image transferring belt 11 does not contact any of the photosensitive drums 101A through 101D or the image transferring rollers 13A through 13D.

FIG. 5B shows a third path which is the moving path when the intermediate image transferring belt 11 of the image forming apparatus 100 is forming monochrome images. While forming monochrome images, in the monochrome image moving member 210, the cam follower 214 abuts the portion (the portion at which the radius is the shortest) closest to the rotating shaft 213 on the circumferential surface of the eccentric cam 212, the concave portion 215AB on the lower side of the transmitting member 215A is positioned above the image transferring roller 13A, and the image transferring roller 13A is close to the photosensitive drum 101A and actually abuts the photosensitive drum 101A, sandwiching the intermediate image transferring belt 11.

Furthermore, while forming monochrome images, in the color image moving member 220, the cam follower 224 abuts the portion halfway from the rotating shaft 223 on a circumferential surface of the second eccentric cam 222 (the portion at which the radius is halfway between the longest radius and the shortest radius), the concave portions 215BC through 215DC on the upper side of the transmitting members 215B through 215D are positioned above the image transferring rollers 13B through 13D, and the image transferring rollers 13B through 13D separate from the photosensitive drums 101B through 101D and the intermediate image transferring belt 11. At the same time, the tilt angle from vertical of the lever 231 on the tension member 230 grows compared to during standby of the image forming operation, and the roller 232 is positioned downward. As a result, part of the upper range of the moving path of the intermediate image transferring belt 11 protrudes by an amount smaller than during standby of the image forming operation.

Accordingly, during formation of monochrome images, the intermediate image transferring belt 11 is pushed upward by the roller 232 of the tension member 230 in the upper range of the moving path of the intermediate image transferring belt 11, and the intermediate image transferring belt 11 abuts the photosensitive drum 101A via the image transferring roller 13A in the lower range of the moving path of the intermediate image transferring belt 11, while the image transferring rollers 13B through 13D separate upward away from the intermediate image transferring belt 11. Therefore, when the intermediate image transferring belt 11 separates from the circumferential surface of the driven roller 11B in the lower range of the moving path, it abuts the photosensitive drum 101A and the circumferential surface of the image transferring roller 13A and then contacts the circumferential surface of the driving roller 11A, without contacting the photosensitive drums 101B through 101D or the image transferring rollers 13B through 13D.

FIG. 5C shows a second path which is the moving path when the intermediate image transferring belt 11 of the image forming apparatus 100 is forming full color images. While forming full color images, in the monochrome image moving member 210, the cam follower 214 abuts the portion (the portion at which the radius is the shortest) closest to the rotating shaft 213 on the circumferential surface of the eccentric cam 212, the concave portion 215AB on the lower side of the transmitting member 215A is positioned above the image transferring roller 13A, and the image transferring roller 13A contacts the photosensitive drum 101A and actually abuts the photosensitive drum 101A, sandwiching the intermediate image transferring belt 11.

Further, while forming full color images, in the color image moving member 220, the cam follower 224 abuts the portion closest to the rotating shaft 223 on the circumferential surface of the eccentric cam 222, the concave portions 215BB through 215DB on the lower side of the transmitting members 215B through 215D are positioned above the image transferring rollers 13B through 13D, and the image transferring rollers 13B through 13D are close to the photosensitive drum 101A and actually abut the photosensitive drum 101A, sandwiching the intermediate image transferring belt 11. At the same time, the tilt angle from vertical of the lever 231 on the tension member 230 grows largest, and the roller 232 is positioned at the lowest position. As a result, part of the upper range of the moving path of the intermediate image transferring belt 11 ceases to protrude upward.

Accordingly, when forming full color images, the intermediate image transferring belt 11 moves approximately horizontally after separating from a circumferential surface of the driving roller 11A until reaching a circumferential surface of the driven roller 11B in the upper range of the moving path of the intermediate image transferring belt 11. The intermediate image transferring belt 11 abuts all the photosensitive drums 101A through 101D by the image transferring rollers 13A through 13D in the lower range of the moving path of the intermediate image transferring belt 11. Therefore, when the intermediate image transferring belt 11 separates from the circumferential surface of the driven roller 11B in the lower range of the moving path, it abuts the photosensitive drums 101A through 101D and the circumferential surface of the image transferring rollers 13A through 13D and then contacts the circumferential surface of the driving roller 11A.

In this way, with the image forming apparatus 100, the moving path of the intermediate image transferring belt 11 selectively changes to any of the first through third paths based on the rotation of the eccentric cams 212 and 222 in accordance with the type of image forming operation. Since the intermediate image transferring belt 11 does almost not expand or contract depending on the moving direction, the shape of the eccentric cam 222 and the shape and position of the tension member 230 are determined such that the total length of the moving path of the intermediate image transferring belt 11 for any of the first through the third paths is always maintained constant.

Figure 6:
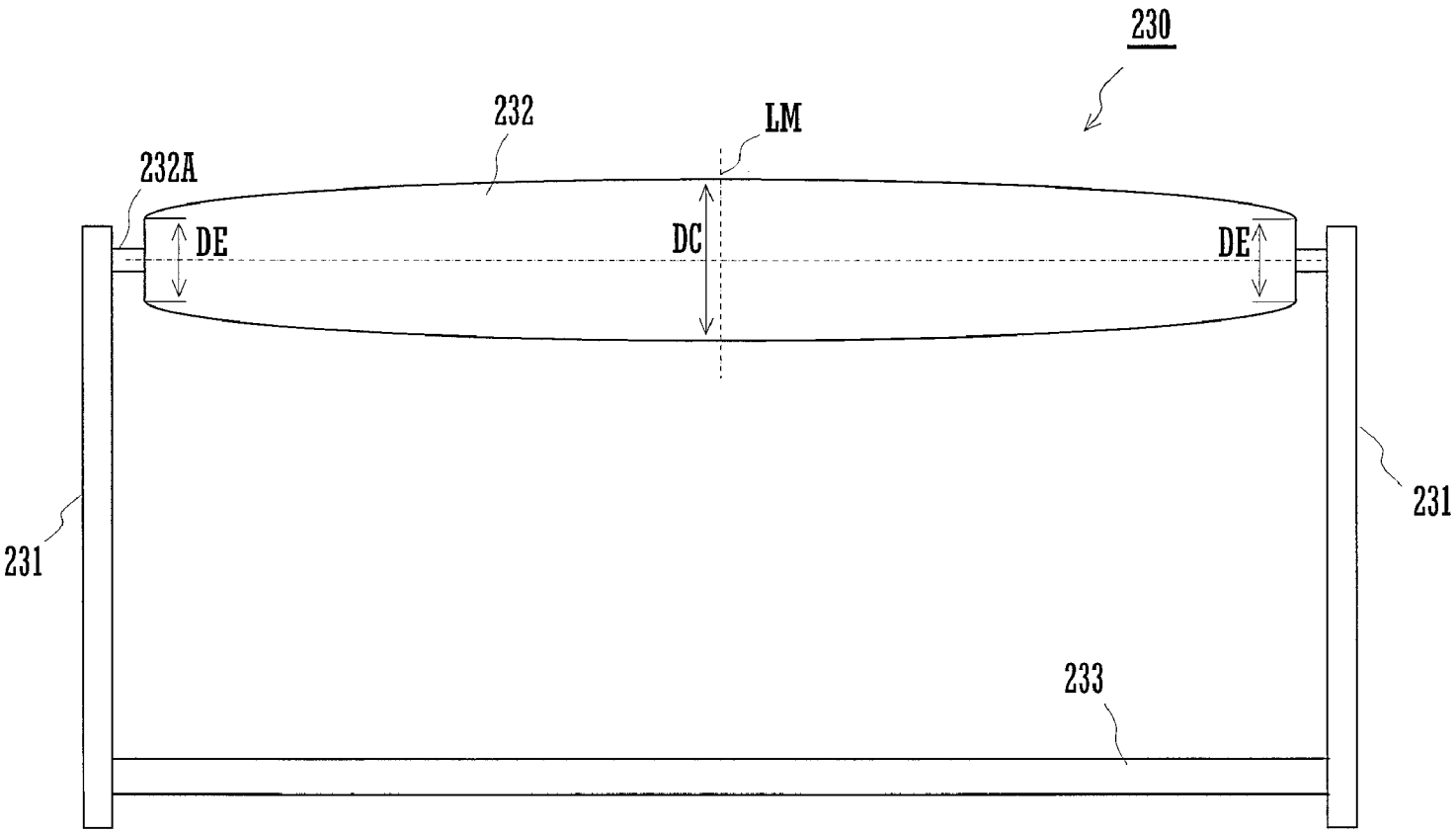
FIG. 6 is a lateral view of a roller included in a tension member in the image forming apparatus.

FIG. 6 is a lateral view of a roller included in a tension member in the image forming apparatus. The rotating shaft 232A protrudes from both end portions in the axis direction of the roller 232, and both end portions of the rotating shaft 232A are axially supported at one end portion of a pair of levers 231. The pair of levers 231 is axially supported by the rotating shaft 233. The length in the axial direction of the roller 232 which abuts a circumferential surface to part of the inner surface of the intermediate image transferring belt 11 is approximately equal to the width of the intermediate image transferring belt 11. A diameter DC at a central portion in the axial direction of the roller 232 is larger than a diameter DE at either end portion, and are symmetrical with respect to a central line LM in the axial direction.

An abutting force can be applied to the entire width of the intermediate image transferring belt 11 from the circumferential surface of the roller 232, and force can be applied on the intermediate image transferring belt 11 towards the central portion from the end portions in the width direction (the axial direction of the roller 232) during rotational movement. Accordingly, in a case in which the intermediate image transferring belt 11 rotationally moves at high speed, the intermediate image transferring belt 11 can be rotationally moved in a stable fashion without causing meandering in the intermediate image transferring belt 11.

Figure 7:
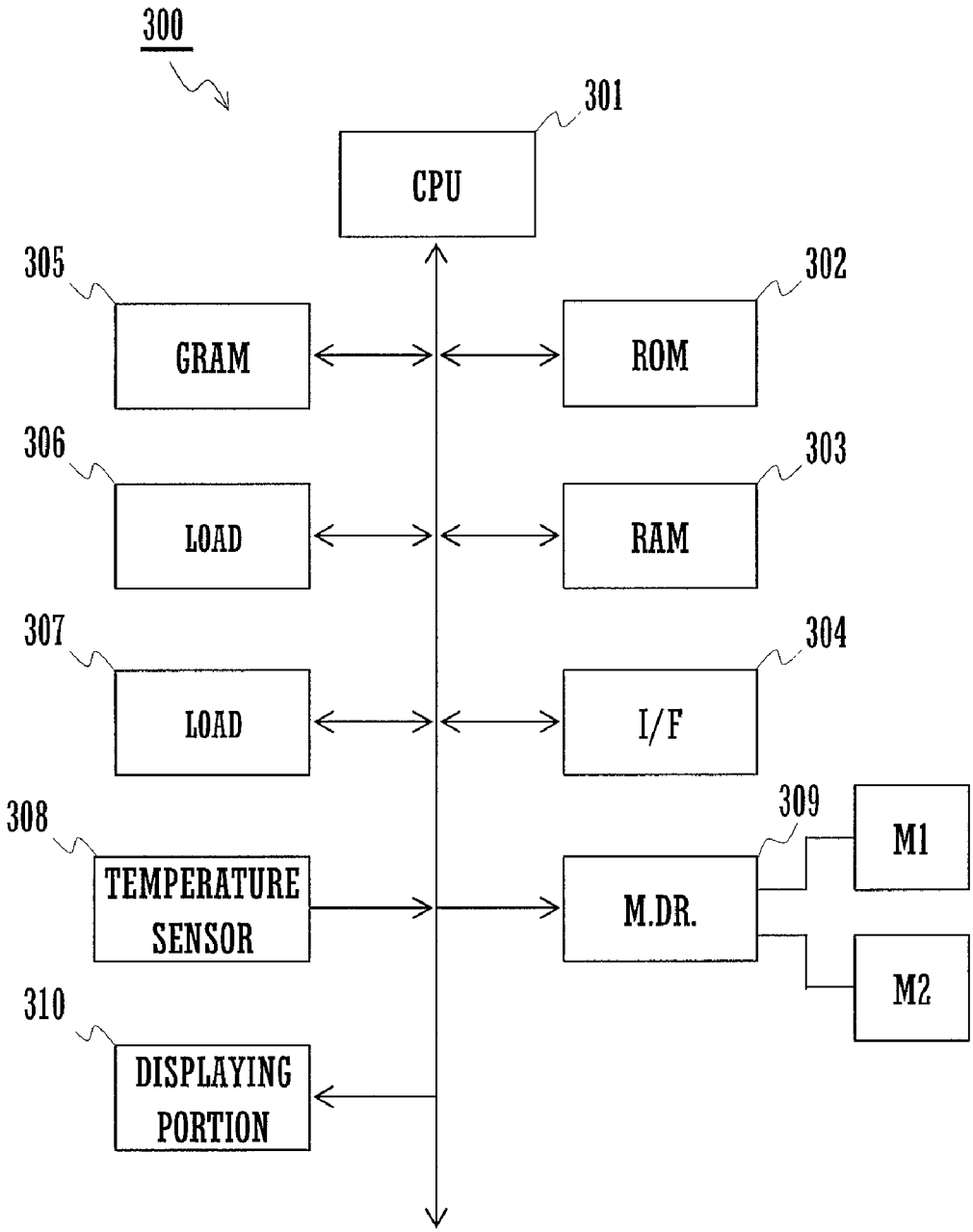
FIG. 7 is a block diagram showing a configuration of a controlling portion of the image forming apparatus.

FIG. 7 is a block diagram showing a configuration of a controlling portion of the image forming apparatus. A controlling portion 300 of the image forming apparatus 100 is made up of a CPU 301, which is provided with a ROM 302 and a RAM 303, and to which are connected input/output devices such as an interface 304, an image memory 305, a paper feeding carrying portion load device 306, an image forming portion load device 307, a temperature sensor 308, a motor driver 309, and a displaying portion 310. The CPU 301 controls these input/output devices according to programs written to the ROM 302 ahead of time, and stores data which is input and output therebetween to a predetermined memory area in the RAM 303. The CPU 301 is connected to an external image output device such as a personal computer via an interface 304, and stores image data input from the interface 304 in the image memory 305.

The paper feeding portion load device 306 includes a motor, a clutch, and a sensor for feeding and carrying paper one sheet at a time from the paper feeding tray 16 or the manual paper feeding tray 17. The image forming portion load device 307 includes a motor, a clutch, and a sensor for forming images on the paper by the image forming stations PA through PD and the fixing device 15. The temperature sensor 308 detects the temperature of a heating roller 15A in the fixing device 15. The motor driver 309 drives the motors M1 and M2 for supplying rotational power to the rotating shafts 213 and 223 which are disposed inside the intermediate image transferring belt 11. The displaying portion 310 displays operational status and so on to a display based on display data supplied from the CPU 301.

Figure 8:
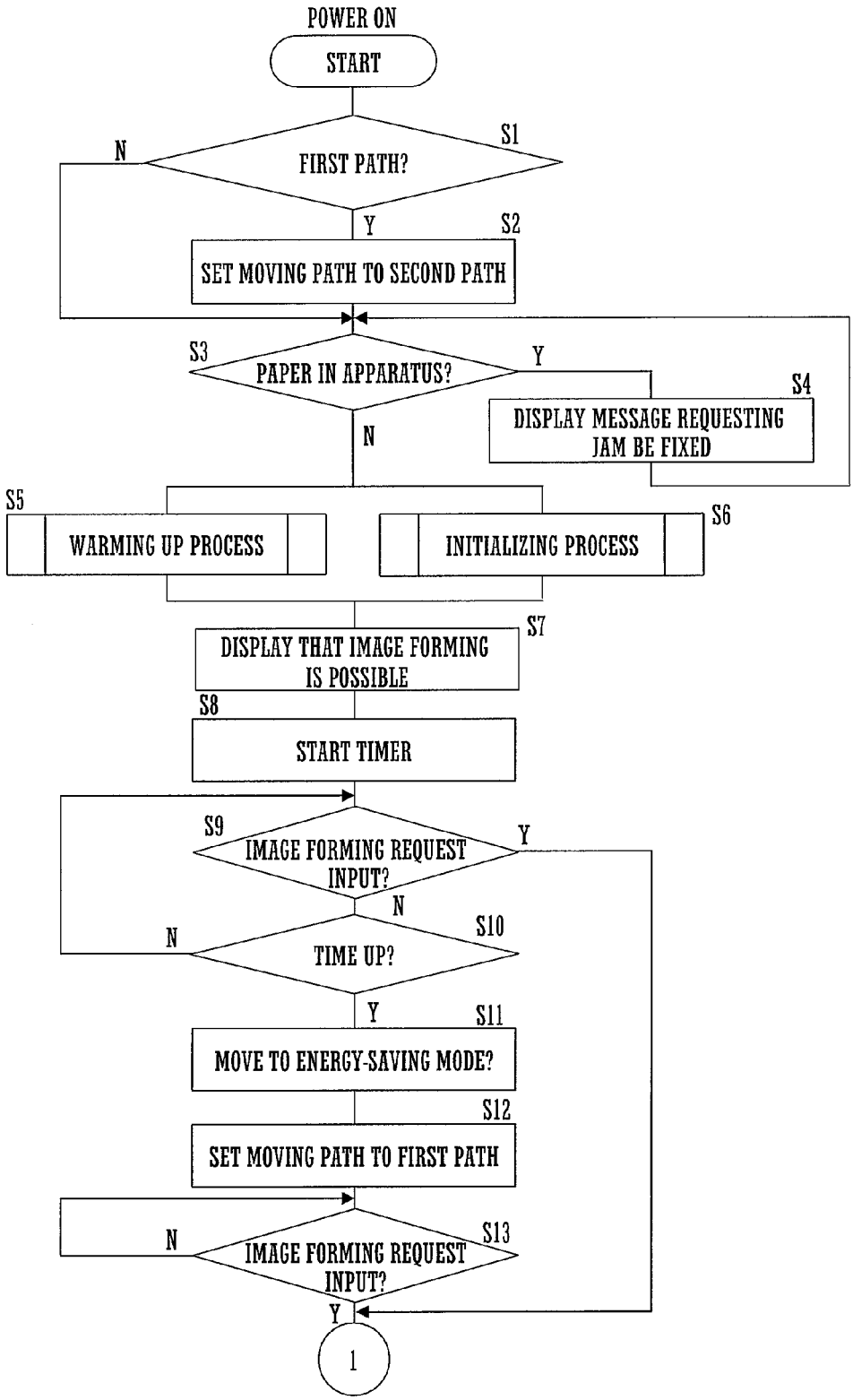
FIG. 8 is a flow chart showing a process sequence of the controlling portion when the image forming apparatus powers up.
Figure 9:
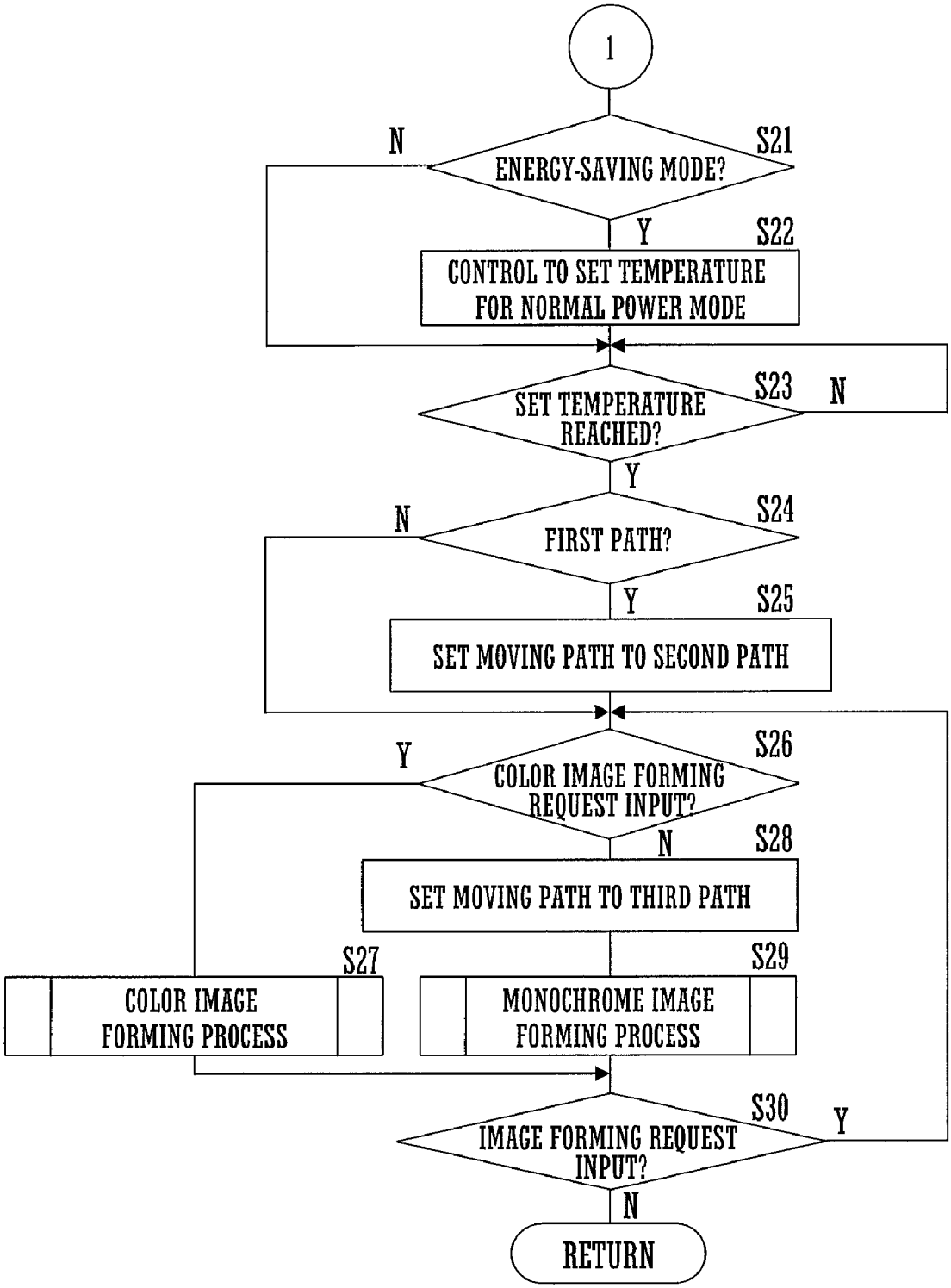
FIG. 9 is a flow chart showing a process sequence of the controlling portion when an image forming request is input from an external image outputting apparatus.

FIG. 8 and FIG. 9 are flow charts showing process sequences of the controlling portion of the image forming apparatus described above. FIG. 8 shows a process sequence when the apparatus powers up, and FIG. 9 shows a process sequence when an image forming request is input from the external image output device.

As shown in FIG. 8, when the power to the image forming apparatus 100 is turned on, the CPU 301 detects the status of the intermediate image transferring belt 11 (S1) and drives the motors M1 and M2 such that the moving path of the intermediate image transferring belt 11 is the second path shown in FIG. 3C or FIG. 5C (S2). Next, the CPU 301 determines whether or not there is paper in the paper carrying path (S3), and, if there is paper in the paper carrying path, displays a message to the displaying portion 310 to remove the paper (S4). When there is no long paper in the paper carrying path, the CPU 301 performs a warming up process and an initializing process (S5 and S6). The warming up process is a process for raising the heating roller 15A in the fixing device 15 to a set temperature. The initializing process includes eliminating residual potential in the photosensitive drums 101A through 101D, optimizing the reserve charge of the developer and the developer density in the developing units 102A through 102D, initializing the sensors and timers, and so on.

When the warming up process and initializing process are complete, the CPU 301 displays a message to the displaying portion 310 that image forming operations are possible (S7), and the timer allocated to a memory area MA1 in the RAM 303 is launched and the presence of input of image forming requests is determined (S8 and S9). If the timer measures a predetermined time without an image forming request being input (S10), the CPU 301 changes the control temperature of the fixing device 15 to an energy-saving temperature, which is lower than the set temperature (S11), and sets the moving path of the intermediate image transferring belt 11 to the first path shown either in FIG. 3A or FIG. 5A by driving the motors M1 and M2 via the motor driver 309 (S12).

Through the above processes, the CPU 301 executes the warming up process and the initializing process with the moving path of the intermediate image transferring belt 11 set to the second path, and if a predetermined time passes without an image forming request being input with the apparatus in a state in which the warming up process and the initializing process are complete and image forming is possible, the CPU 301 puts the image forming apparatus 100 in energy-saving mode and reduces power consumption. At this time, the CPU 301 changes the moving path of the intermediate image transferring belt 11 to the first path, so the intermediate image transferring belt 11 does not contact the photosensitive drums 101A through 101D or the image transferring rollers 13A through 13D, in a state in which image forming operations are not executed, which means that neither partial deformation of the intermediate image transferring belt 11 nor partial deterioration of the circumferential surface of the photosensitive drums 101A through 101D occur.

When an image forming request is input from an external image output device in step S9 or step S13 in FIG. 8, the CPU 301 determines whether or not the apparatus is set to energy-saving mode (S21), and, if energy-saving mode is set, returns the power status of the image forming apparatus 100 to normal and changes the control temperature of the fixing device 15 to the set temperature (S22). When the fixing device reaches the set temperature (S23), the CPU 301 determines whether or not the moving path of the intermediate image transferring belt 11 is the first path (S24), and, if the moving path of the intermediate image transferring belt 11 is the first path, changes the moving path of the intermediate image transferring belt 11 to the second path (S25).

Next, if the input image forming request is for a full color image, the CPU 301 executes full color image forming with the moving path of the intermediate image transferring belt 11 set to the second path (S26, S27, S30). If the input image forming request is for a monochrome image, the CPU 301 changes the moving path of the intermediate image transferring belt 11 to the third path, and then executes monochrome image forming (S26, S28 through S30).

With the above processes, when an image forming request for a full color image is input, the CPU 301 changes the moving path of the intermediate image transferring belt 11 to the second path shown in FIG. 3C or FIG. 5C, and executes full color image forming by contacting the intermediate image transferring belt 11 to all the photosensitive drums 101A through 101D and the image transferring rollers 13A through 13D. With the above processes, when an image forming request for a monochrome image is input, the CPU 301 changes the moving path of the intermediate image transferring belt 11 to the third path shown in FIG. 3B or FIG. 5B, and executes monochrome image forming by contacting the intermediate image transferring belt 11 only to the photosensitive drum 101A and the image transferring roller 13A. When forming monochrome images, the intermediate image transferring belt 11 does not contact the photosensitive drums 101B through 101D and the image transferring rollers 13B through 13D, which are not used during the image forming operation, so the deterioration of the photosensitive drums 101B through 101D and the image transferring rollers 13B through 13D can be prevented, as can the mixing of toners of different colors in the developing devices 102A through 102D. Accordingly, the moving path of the intermediate image transferring belt 11 can be set to an appropriate state according to a plurality of types of image forming.

Figure 10B:
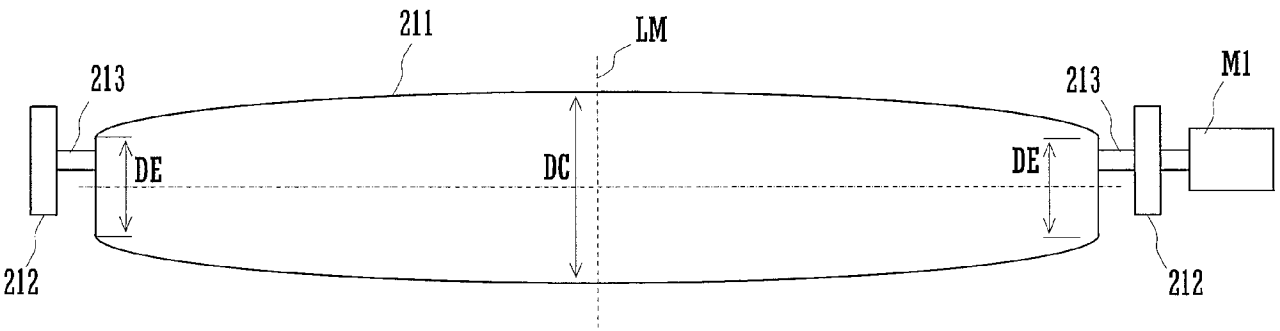
FIGS. 10A and 10B are a frontal view and a lateral view, respectively, of a first eccentric cam and a second eccentric cam in the image forming apparatus.
Figure 10A:
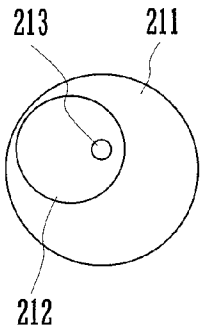

FIG. 10A and FIG. 10B are a frontal and a lateral view, respectively, of the first eccentric cam in the image forming apparatus described above. FIGS. 10A and 10B show the first eccentric cam 211, the second eccentric cam 212, the rotating shaft 213, and the motor M1, but the first eccentric cam 221, the second eccentric cam 222, the rotating shaft 223, and the motor M2 are configured similarly.

The length in the axial direction of the first eccentric cam 211 whose circumferential surface abuts part of the inner surface of the intermediate image transferring belt 11 is approximately equal to the width of the intermediate image transferring belt 11. A diameter DC at a central portion in the axial direction of the eccentric cam 211 is larger than a diameter DE at either end portion, and are symmetrical with respect to a central line LM in the axial direction.

An abutting force can be applied to the entire width of the intermediate image transferring belt 11 from the circumferential surface of the first eccentric cam 211, and force can be applied on the intermediate image transferring belt 11 towards the central portion from the end portions in the width direction (the axial direction of the first eccentric cam 211) during rotational movement. Accordingly, in a case in which the intermediate image transferring belt 11 rotationally moves at high speed, the intermediate image transferring belt 11 can be rotationally moved in a stable fashion without causing meandering in the intermediate image transferring belt 11.

The rotating shaft 213 protrudes from both end portions in the axial direction of the first eccentric cam 211 and the second eccentric cam 212 is fixed to both end portions of the rotating shaft 213. The rear surface side of the rotating shaft 213 pierces the eccentric cam 212, and a rotating shaft of the motor M1 is connected. Through the drive from the motor M1, the first eccentric cam 211 and the second eccentric cam 212 rotate as a unit. Since the second eccentric cam 212 is provided in both the front surface and the rear surface of the intermediate image transferring belt 11, the image transferring roller 13A can be moved in a stable fashion via the cam follower 214 and the transmitting member 215A, as described above.

Moreover, the first eccentric cams 211 and 221 may be such that they always abut the inner circumferential surface of the intermediate image transferring belt 11 at two places, one on an upper side and one on a lower side, of the loop-shaped moving path formed by the intermediate image transferring belt 11.

The invention claimed is:

1. A transfer endless belt device applied to an image forming apparatus, comprising:

an endless belt for forming a loop-shaped moving path, stretched out between a driving roller and a driven roller which are affixed to positions inside the apparatus;

a plurality of image bearing members provided in a row within a prescribed range along a moving direction of the endless belt;

a plurality of image transferring members disposed within the moving path, and respectively opposed to the image bearing members across the endless belt;

an image transferring member supporting mechanism for approximating and separating the image transferring members to and from the image bearing members; and a belt supporting mechanism for contacting and separating the endless belt to and from the image bearing members in accompaniment of an operation of the image transferring member supporting mechanism, wherein the image transferring member supporting mechanism and the belt supporting mechanism are disposed within the moving path, and the belt supporting mechanism is rotatably supported and includes a first eccentric cam whose circumferential surface abuts an inner circumferential surface of the endless belt.

2. The transfer endless belt device applied to the image forming apparatus according to claim 1, wherein the image bearing members is made up of a plurality of image bearing members for color images on which are formed toner images of three subtractive primary colors during full color image formation, and an image bearing member for monochrome images on which is formed a black toner image during monochrome image formation, the image transferring member supporting mechanism includes a color image moving member for moving as a unit all image transferring members opposed to the image bearing members for color images, and the belt supporting mechanism includes a color image supporting member for contacting and separating the endless belt to and from the image bearing members for color images in accordance with operation of the color image moving member.

3. The transfer endless belt device applied to the image forming apparatus according to claim 2, wherein the image transferring member supporting mechanism further includes a monochrome image moving member for moving an image transferring member opposed to the image bearing member for monochrome images, and the belt supporting mechanism further includes a monochrome image supporting member for contacting and separating the endless belt to and from the image bearing member for monochrome images in accordance with operation of the monochrome image moving member.

4. The transfer endless belt device applied to the image forming apparatus according to claim 1, wherein the image transferring member supporting mechanism includes a second eccentric cam disposed coaxially with the first eccentric cam, a cam follower that is displaced engaged with a circumferential surface of the second eccentric cam, and a transmitting member for causing the image transferring members to approach to and separate from the image bearing members in accordance with the displacement of the cam follower.

5. The transfer endless belt device applied to the image forming apparatus according to claim 1, wherein the circumferential surface of the first eccentric cam abuts an inner circumferential surface of the endless belt outside the prescribed range in the moving path.

6. The transfer endless belt device applied to the image forming apparatus according to claim 1, wherein the circumferential surface of the first eccentric cam abuts approximately all areas of the endless belt in a width direction.

7. The transfer endless belt device applied to the image forming apparatus according to claim 6, wherein a diameter of a central portion of the first eccentric cam in the axis direction is larger than diameter at either end portion.

8. The transfer endless belt device applied to the image forming apparatus according to claim 5, wherein the cam follower includes a first holding portion for holding the image transferring members close to the image bearing members and a second holding portion for holding the image transferring members away from the image bearing members, the first holding portion and the second holding portion being aligned along the direction of arrangement of the image transferring members, and the cam follower is displaced in the direction of the arrangement of the image transferring members in conjunction with rotation of the second eccentric cam.

9. The transfer endless belt device applied to the image forming apparatus according to claim 1, wherein the endless belt is an intermediate image transferring belt to which are sequentially transferred toner images formed on the image bearing members.

10. A transfer endless belt device applied to an image forming apparatus, comprising:

an endless belt for forming a loop-shaped moving path, stretched out between a driving roller and a driven roller which are affixed to positions inside the apparatus;

a plurality of image bearing members provided in a row within a prescribed range along a moving direction of the endless belt, including a plurality of image bearing members for color images on which are formed toner images of three subtractive primary colors during full color image formation and an image bearing member for monochrome images on which is formed a black toner image during monochrome image formation;

a plurality of image transferring members disposed within the moving path, and respectively opposed to the image bearing members across the endless belt;

an image transferring member supporting mechanism for approximating and separating the image transferring members to and from the image bearing members; and a belt supporting mechanism for contacting and separating the endless belt to and from the image bearing members in accompaniment of an operation of the image transferring member supporting mechanism, wherein the image transferring member supporting mechanism and the belt supporting mechanism are disposed within the moving path, and the belt supporting mechanism is rotatably supported and includes a first eccentric cam whose circumferential surface abuts an inner circumferential surface of the endless belt, and changes a shape of the moving path of the endless belt into one of a first through a third path according to the type of image forming operation.

11. The transfer endless belt device applied to the image forming apparatus according to claim 10, wherein the first path is a path for when an image forming operation is in standby, in which the endless belt is separated from all the image bearing members.

12. The transfer endless belt device applied to the image forming apparatus according to claim 10, wherein the second path is a path during full color image formation, in which the endless belt contacts all the image bearing members, and the third path is a path during monochrome image formation, in which the endless belt contacts the image bearing member for monochrome images and is separated from the image bearing members for full color images.

13. The transfer endless belt device applied to the image forming apparatus according to claim 12, wherein the belt supporting mechanism keeps the circumferential length of the endless belt constant in the first through third paths.

14. A transfer endless belt device applied to an image forming apparatus, comprising:

an endless belt for forming a loop-shaped moving path, stretched out between a driving roller and a driven roller which are affixed to positions inside the apparatus;

a plurality of image bearing members provided in a row within a prescribed range along a moving direction of the endless belt;

a plurality of image transferring members disposed within the moving path, and respectively opposed to the image bearing members across the endless belt;

an eccentric cam for rotating at a rotating angle according to the type of image forming operation around a rotating shaft parallel to rotating shafts of the driving roller and the driven roller;

an image transferring member supporting mechanism for converting a change in radius at a specific rotating angle of the eccentric cam to a displacement in a contacting/separating direction with respect to the image bearing members of the image transferring members; and a tension member, latched to the image transferring member supporting mechanism, for deforming the moving path of the endless belt by, moving in response to an operation of the image transferring member supporting mechanism, wherein the image transferring member supporting mechanism and the tension member are disposed within the moving path, and the image bearing members are made up of a plurality of image bearing members for color images on which are formed toner images of three subtractive primary colors during full color image formation and an image bearing member for monochrome images on which is formed a black toner image during monochrome image formation, and the image transferring member supporting mechanism is latched to the tension member and includes a color image moving member for moving as a unit all image transferring members opposed to the image bearing members for color images, and the tension member, moving in response to the image transferring member supporting mechanism, changes a shape of the moving path of the endless belt into one of a first through a third path according to the type of image forming operation.

15. The transfer endless belt device applied to the image forming apparatus according to claim 14, wherein the image transferring member supporting mechanism further includes a monochrome image moving member for moving an image transferring member opposed to the image bearing member for monochrome images.

16. The transfer endless belt device applied to the image forming apparatus according to claim 14, wherein the image transferring member supporting mechanism includes an abutting portion for abutting a circumferential surface of the eccentric cam at the specific rotating angle position, and the tension member abuts at one end portion an inner circumferential surface of the endless belt and is swingable at another end portion, and is latched to the image transferring member supporting mechanism via an elastic member.

17. The transfer endless belt device applied to the image forming apparatus according to claim 14, wherein the tension member supports, by a rotating shaft parallel to rotating shafts of the driving roller and the driven roller, a roller whose circumferential surface abuts an inner circumferential surface of the endless belt and whose diameter in a central portion in an axis direction is larger than diameters at either end portion.

18. The transfer endless belt device applied to the image forming apparatus according to claim 14, wherein the first path is a path for when an image forming operation is in standby, in which the endless belt is separated from all the image bearing members.

19. The transfer endless belt device applied to the image forming apparatus according to claim 14, wherein the second path is a path during full color image formation, in which the endless belt contacts all the image bearing members, and the third path is a path during monochrome image formation, in which the endless belt contacts the image bearing member for monochrome images and is separated from the image bearing members for full color images.

20. The transfer endless belt device applied to the image forming apparatus according to claim 14, wherein the tension member tenses with a predetermined tensile force the endless belt at at least the second and the third paths.

21. The transfer endless belt device applied to the image forming apparatus according to claim 14, wherein the endless belt is an intermediate image transferring belt to which are sequentially transferred toner images formed on the image bearing members.

* * * * *